US007037080B2

(12) United States Patent
Bucher et al.

(10) Patent No.: US 7,037,080 B2
(45) Date of Patent: May 2, 2006

(54) METHOD OF CONSTRUCTING A FAN BLADE

(75) Inventors: John C. Bucher, Ft. Lauderdale, FL (US); Charles E. Bucher, Valrico, FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 0 days.

(21) Appl. No.: 10/674,276

(22) Filed: Sep. 26, 2003

(65) Prior Publication Data

US 2005/0069416 A1 Mar. 31, 2005

(51) Int. Cl.
*F04D 29/38* (2006.01)

(52) U.S. Cl. ..... 416/231 R; 416/223 R; 416/229 R

(58) Field of Classification Search ..... 416/229 R, 416/223 R, 225, 231 R, 231 B; 403/298, 403/200, 247, 263
See application file for complete search history.

(56) References Cited

U.S. PATENT DOCUMENTS

| | | | | | |
|---|---|---|---|---|---|
| 1,785,543 | A | * | 12/1930 | Dornier | 416/229 R |
| 1,786,644 | A | * | 12/1930 | Davis | 416/135 |
| 2,336,012 | A | * | 12/1943 | Hackethal | 416/209 |
| 2,366,652 | A | * | 1/1945 | Rieger | 446/88 |
| 2,702,926 | A | * | 3/1955 | Rahaim | 403/298 |
| 2,815,997 | A | * | 12/1957 | Korb | 52/584.1 |
| 5,421,430 | A | * | 6/1995 | Cox | 182/181.1 |
| 5,860,389 | A | * | 1/1999 | Caldwell | 119/28.5 |

* cited by examiner

*Primary Examiner*—Ninh H. Nguyen
(74) *Attorney, Agent, or Firm*—Holland & Knight LLP

(57) ABSTRACT

An improved fan blade is constructed from a series of wooden slats. Holes are drilled through the wooden slats and a dowel is placed through each of the holes. The dowel is preferably a wooden rod that is secured in the hole with wood glue. Alternatively, the dowels may be constructed from metal and have threaded ends that receive threaded end caps. The end caps are placed over the ends of the dowel to firmly secure the wooden slats together. The design provides improved rigidly and reduces the likelihood of portions of the fan blade breaking loose. The improved rigidity further allows the use of softer, less dangerous and less expensive materials to be used in the construction of the fan blade.

20 Claims, 3 Drawing Sheets

METHOD OF CONSTRUCTING A FAN BLADE

FIELD OF THE INVENTION

The present invention generally relates to fans. More particularly, the present invention is directed toward an improved fan blade that is less expensive to construct and safer to operate than conventional fan blades

BACKGROUND OF THE INVENTION

Fans in general and ceiling fans in particular are well known devices that are used to circulate air for a variety of purposes. These fan blades may be constructed from metal, plastic, wood or other materials. Ceiling fans blades are often constructed from wood due to its aesthetic appeal and softer nature. Due to the width of ceiling fan blades, wooden blades are often constructed from laminated slats of wood that are held together. Such a prior art fan blade is shown in FIG. 1. The blade 2 consists of a series of slats 4 that are held in place by pieces of wood 6 that have been glued in grooves running perpendicular to the slats 2. Unfortunately, these perpendicular pieces of wood tend to break loose and/or warp over time. This is particularly a problem in connection with ceiling fans because the pieces may be ejected into a room where people are present. Therefore, what is needed is an improved method of constructing a fan blade for a ceiling fan or a fan blade operatively connected to the motor of the ceiling fan.

SUMMARY OF THE INVENTION

A preferred embodiment of the present invention is directed toward a fan blade that includes at least two longitudinal slats positioned side by side. At least one hole is constructed through an interior of the at least two longitudinal slats. A dowel is pressed through the hole to secure the two longitudinal slats firmly together. The dowel is preferably a wooden rod that is secured in the hole with an adhesive such as wood glue. The wooden rod may have grooves, notches or splines that improve its ability to bond to the interior of the slats. In an alternative embodiment, the dowel is a metal rod. A threaded portion may be placed on one end of the metal rod for receiving a screw on cap that secures the dowel in the hole. A fixed cap is rigidly secured to the other end of the dowel. The screw on cap is designed to retract the screw on cap and the fixed cap into the slats when screwed on to the threaded portion. The screw on cap has a portion configured to receive a tool to facilitate its attachment to the dowel. The slats are preferably constructed from a soft wood. In yet another alternative embodiment, both ends of the dowel are threaded to receive threaded end caps. The threaded caps are designed to receive a tool for securing the threaded end caps to the threaded ends of the dowel. A bonding material may be placed over the threaded end caps such that the dowel and the end caps are enclosed within the slats.

DETAILED DESCRIPTION OF THE INVENTION

Figure 2:
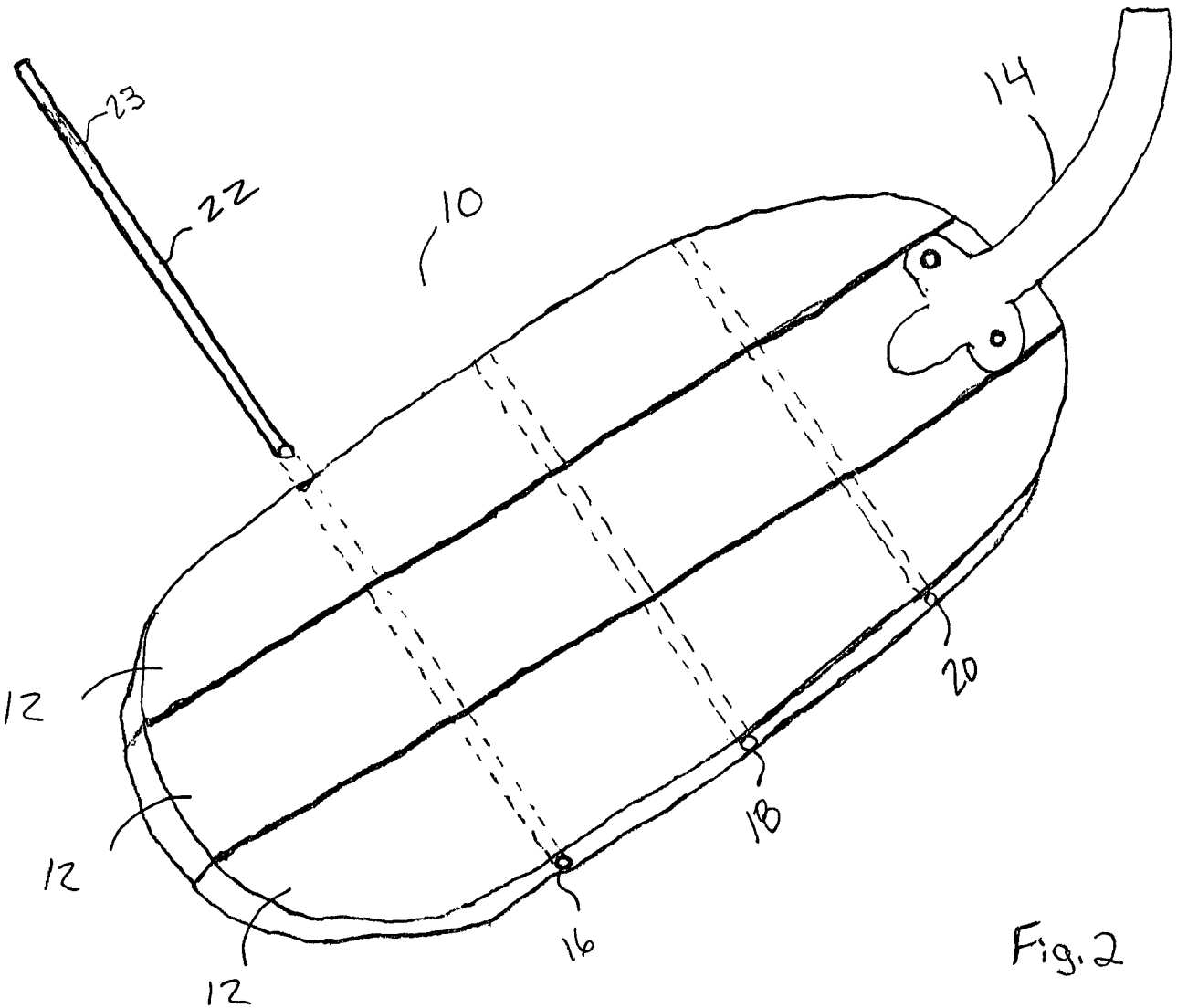
FIG. 2 is a pictorial representation of a preferred embodiment of the present invention.

Referring now to FIG. 2, a fan blade 10 constructed in accordance with a preferred embodiment of the present invention is shown. The fan blade 10 is constructed from a series of wooden slats 12 and supported by a blade arm 14. The blade arm 14 is attached to a spinning fan wheel (not shown) that rotates the fan blade 10 through the air to produce the desired circulation. The wooden slats 12 have a series of substantially perpendicular holes 16, 18 and 20 that have been drilled through their interior. A dowel 22 is inserted or press fit into each of the perpendicular holes 16, 18 and 20 to hold the slats 12 firmly together. Preferably, the dowel 22 is wooden and dimensioned such that it can be snugly inserted into the hole 16. In such an embodiment, wood glue is preferably placed around the dowel 22 to further secure it in the hole. In addition, small grooves, notches or splines 23 can be constructed along the length of the dowel 22 to help further secure the dowel 22 in the hole 16. In an alternative embodiment, the dowel 22 is a straight metal rod or pin.

Figure 1:
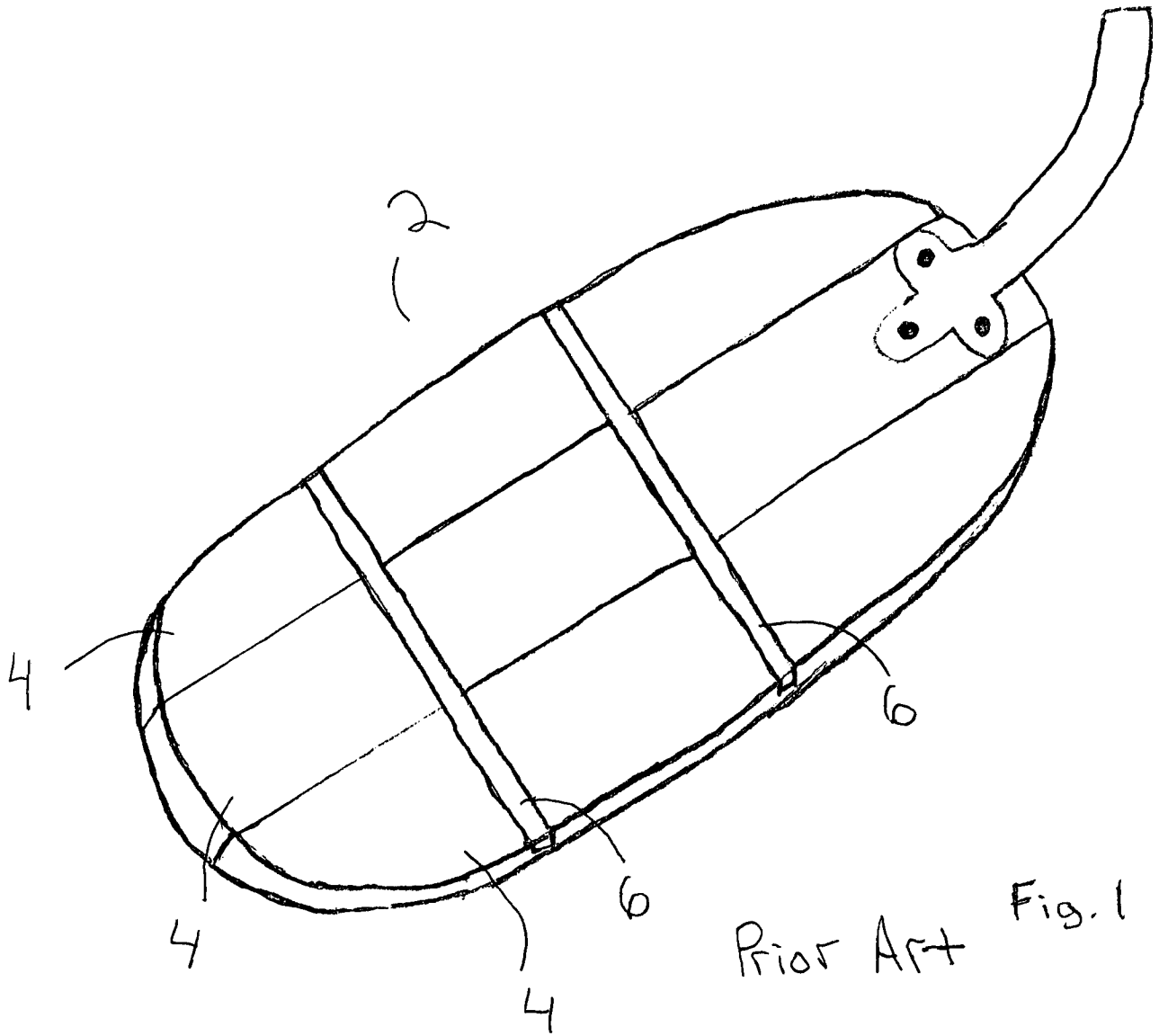
Fig. 1 Prior Art
FIG. 1 is a pictorial representation of a prior art method of constructing a fan blade.

The dowel 22 increases the rigidity of the fan blade 10 by being firmly secured within the interior of the wooden slats 12. In addition, the wooden slats 12 can not warp or peal away from each other or the dowel 22 as was the case with the prior art method of FIG. 1 without breaking the wooden slats 12. This is especially important when used with a ceiling fan in that there is nothing to break loose and be ejected into the room. The added rigidly provided by the dowel 22 also allows softer woods such as pine, medium density fiberboard, etc. to be used to construct the fan blade 10. The use of softer woods is further beneficial in that softer wood is typically less expensive and less likely to injure someone that comes into contact with the fan blades.

Figure 3A:
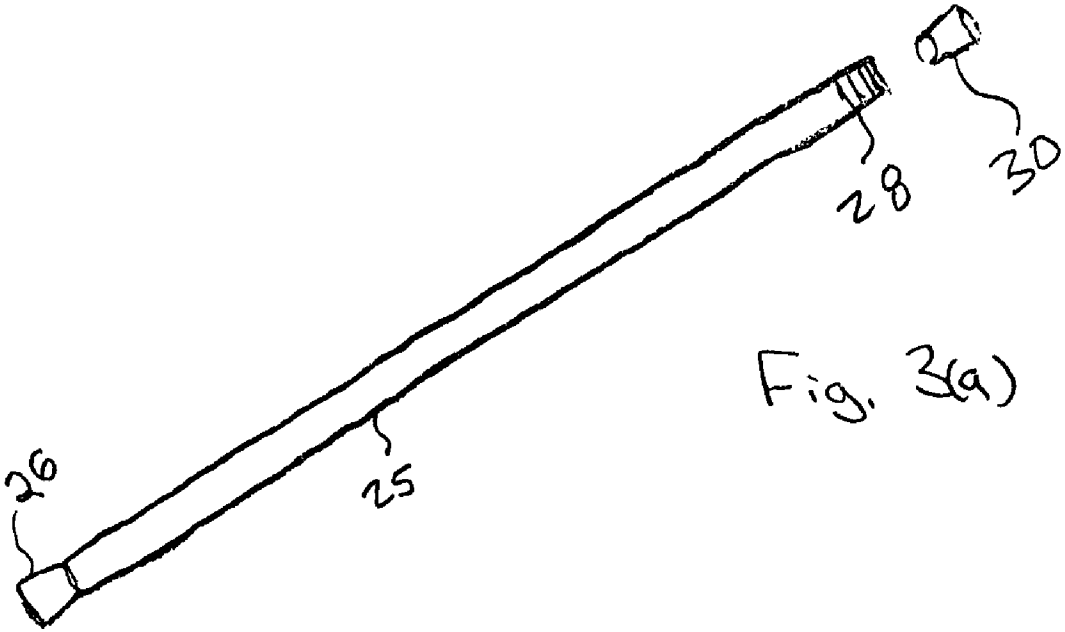
FIGS. 3(*a*) and (*b*) are pictorial representations of a dowel or pin for use with an alternative embodiment of the present invention.
Figure 3B:
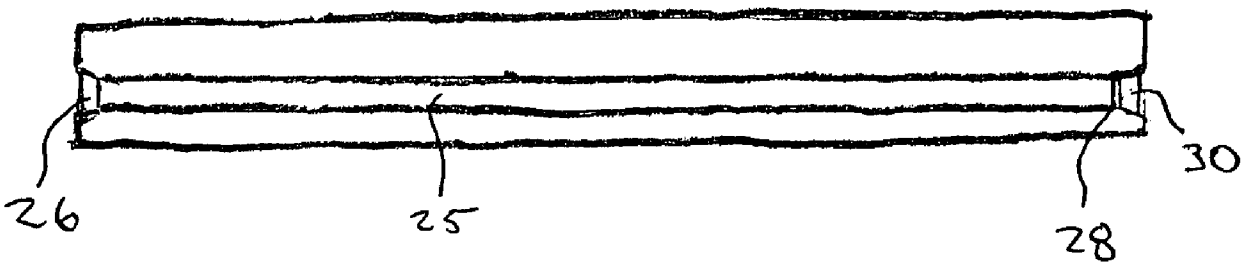

An alternative dowel 24 is constructed and installed as set forth in FIGS. 3(*a*) and (*b*). The dowel 24 is primarily constructed from a rod 25. The rod 25 is constructed from metal, wood, plastic or other similar materials. One end of the rod 25 of the dowel 24 has a truncated cone shaped end 26 that preferably has a maximum diameter that is slightly larger in diameter than the through holes 16, 18 and 20 constructed through the wooden slats 12 as shown in FIG. 2. The other end of the rod 24 has threads 28 that are designed to be received by a hole in a second truncated cone shaped cap 30. Alternatively, both ends of the rod 25 may have threaded ends 28 and screw on end caps 30. A friction fit may also be used to secure the end caps 30 on the dowel 24. The dowel 24 is installed in the wood slats 12 by pressing the rod 25 through one of the through holes 16, 18 or 20 such that the truncated cone shaped end 26 is firmly held against one of the outermost wooden slats 12. The length of the rod 25 is preferably selected such that the threaded end 28 will almost protrude through the outer most wooden slat on the other side. The truncated cone shaped cap 30 is then screwed onto the threaded end 28. In a friction fit embodiment, the end caps 30 could simply be compressed onto the rod 25. The end caps 30 are preferably configured to receive a screw driver or similar tool to facilitate their attachment to the dowel 24 rod 25. The end cap 30 is also preferably secured onto the end 28 such that the cone shaped end 26 and end cap 30 are pulled slightly below the outermost surface of the wooden slats 12 to remove them from view and improve the appearance of the fan blade as shown in FIG. 3(*b*). A putty or similar compound is then used to cover the ends 26 and 30 and provide a smooth exterior finish.

The construction set forth above is a substantial improvement upon the prior art. First, the interior location of the dowel reduces the likelihood that the dowel will separate from the slats and be ejected from the fan blades. Second, the dowel provides extra rigidity that prevents warpage and allows softer less expensive and safer materials to be used for the fan blades. Finally, the dowel is completely enclosed by the slats to produce an aesthetically pleasing and stable design.

We claim:

1. A fan comprising:

a motor; and a fan blade operatively connected to said motor, said fan blade including at least two longitudinal slats, each said longitudinal slat comprising a longitudinal length, a width and a thickness, said longitudinal length being several times longer than said width, said width being several times longer than said thickness, said longitudinal slats being positioned side by side with their said widths being in the same plane to define a generally planar fan blade of an overall width generally equal to the sum of said widths, an overall thickness generally equal to said thickness and an overall length generally equal to said longitudinal length;

a transverse through-hole constructed through an interior of each of said longitudinal slats across said width thereof, said transverse through-holes in respective said slats being colinear with each other when said slats are positioned side-by-side; and a dowel placed through said transverse through-holes to secure said longitudinal slats firmly together with their said widths in the same plane.

2. The fan of claim 1 wherein said dowel further comprises a wooden rod dimensioned to fit in said hole.

3. The fan of claim 2 wherein said wooden rod is secured in said hole with wood glue.

4. The fan of claim 2 wherein said wooden rod farther comprises spines or grooves.

5. The fan of claim 1 further comprising a threaded portion on one end of said dowel for receiving a cap that secures said dowel in said hole.

6. The fan of claim 5 wherein said dowel further comprises a fixed cap rigidly secured to one end of said dowel.

7. The fan of claim 6 wherein said screw on cap is designed to retract said screw on cap and said fixed cap into said slats when screwed on to said threaded portion.

8. The fan of claim 1 further comprising end caps for securing said dowel in said hole.

9. The fan of claim 1 wherein said slats are constructed from a soft wood.

10. The fan of claim 1 wherein both ends of said dowel are threaded to receive threaded end caps.

11. The fan of claim 10 wherein said threaded caps are designed to receive a tool for securing said threaded end caps to said threaded ends of said dowel.

12. The fan of claim 1 wherein a material is placed over exposed ends of said dowel such that said dowel is enclosed within said slats.

13. A fan comprising:

a motor; and a fan blade operatively connected to said motor, said fan blade including a series of thin longitudinal slats positioned edge-wise parallel to each other in the same plane;

a hole running approximately perpendicular to said series of thin longitudinal slats through an interior portion of said slats from one edge to the other; and a wooden dowel configured to be received in said hole such that said series of slats are secured together in the same plane to form a fan blade generally equal to the sum of the widths of said thin longitudinal slats.

14. The fan of claim 13 further comprising an adhesive for securing said wooded dowel in said hole.

15. The fan of claim 13 wherein said wooden dowel further comprises grooves.

16. The fan of claim 13 wherein said slats are wooden.

17. A fan comprising:

a motor; and a fan blade operatively connected to said motor, said fan blade including at least two longitudinal wooden slats;

at least one hole constructed width-wise through said longitudinal wooden slats; and a dowel configured to be received in said holes such that said at least two longitudinal slats are held firmly together width-wise in the same plane.

18. The fan of claim 17 wherein said dowel comprises a metal dowel including an expanded end portion.

19. The fan of claim 18 wherein said expanded end portion is received by a threaded end on said metal dowel.

20. The fan of claim 17 further comprising end caps for securing said metal dowel in said at least one hole.

* * * * *